US009873550B2

(12) United States Patent
LaMee

(10) Patent No.: US 9,873,550 B2
(45) Date of Patent: Jan. 23, 2018

(54) DISPENSING CONTAINER BALLAST

(71) Applicant: Maurice LaMee, Ormond Beach, FL (US)

(72) Inventor: Maurice LaMee, Ormond Beach, FL (US)

( * ) Notice: Subject to any disclaimer, the term of this patent is extended or adjusted under 35 U.S.C. 154(b) by 0 days.

(21) Appl. No.: 15/176,581

(22) Filed: Jun. 8, 2016

(65) Prior Publication Data

US 2017/0355490 A1 Dec. 14, 2017

(51) Int. Cl.
*F16M 11/00* (2006.01)
*B65D 25/20* (2006.01)
*A47K 10/42* (2006.01)

(52) U.S. Cl.
CPC ..... *B65D 25/20* (2013.01); *A47K 10/421* (2013.01)

(58) Field of Classification Search
USPC ..... 248/682
See application file for complete search history.

(56) References Cited

U.S. PATENT DOCUMENTS 1,667,869 A * 5/1928 Peterson ..... B65D 77/02 229/139
2,083,868 A * 6/1937 Rottman ..... B65D 21/086 220/8
3,110,467 A * 11/1963 Dube ..... A47K 10/185 248/311.2
3,197,062 A * 7/1965 Day ..... B65D 5/0005 206/451
3,284,041 A * 11/1966 Tjaden ..... B60R 7/084 224/277
3,896,966 A * 7/1975 Canno ..... B65D 83/0852 206/494
4,380,314 A * 4/1983 Langston, Jr. ..... B65D 5/6626 229/122.32
4,616,767 A * 10/1986 Seido ..... A47K 10/421 221/58
5,823,497 A * 10/1998 Weatherhead ..... A47K 10/185 248/316.7
5,992,683 A * 11/1999 Sigl ..... A47K 10/422 221/52
6,334,544 B1 * 1/2002 Christensen ..... A47K 10/424 221/303
6,926,149 B2 * 8/2005 Tippey ..... B65D 75/5833 206/438
7,273,156 B2 * 9/2007 Gao ..... B65D 83/0805 221/47
7,275,654 B2 10/2007 Christensen
7,870,983 B2 * 1/2011 Chen ..... B60R 11/00 224/275
8,128,048 B2 * 3/2012 Odishoo ..... A47K 10/185 248/316.7
8,196,806 B2 * 6/2012 Tao ..... B65D 5/324 229/122.26
9,414,722 B2 * 8/2016 Matthews ..... B65D 83/00
(Continued)

*Primary Examiner* — Monica E Millner
(74) *Attorney, Agent, or Firm* — Dunlap Bennett & Ludwig PLLC; Brendan E. Squire

(57) ABSTRACT

A dispenser container ballast for removably providing an additional mass to a light weight dispenser container. The container ballast includes a weighted mass that may be inserted between a sidewall of a dispenser container and a flap secured to the sidewall. The ballast permits single handed dispensing of carried by the dispenser, such as a tissue.

12 Claims, 3 Drawing Sheets

(56) References Cited

U.S. PATENT DOCUMENTS

| | | | | |
|---|---|---|---|---|
| 2001/0019072 | A1* | 9/2001 | Wu | B60R 7/084 224/277 |
| 2002/0036153 | A1* | 3/2002 | Yang | A47K 10/421 206/494 |
| 2002/0067038 | A1* | 6/2002 | Tran | B65D 5/425 281/29 |
| 2002/0139693 | A1* | 10/2002 | Sowers | B65D 85/00 206/45.28 |
| 2002/0175176 | A1* | 11/2002 | Cheng | B65D 83/0805 221/45 |
| 2008/0116217 | A1* | 5/2008 | Klein | A47K 10/421 221/1 |

* cited by examiner

DISPENSING CONTAINER BALLAST

BACKGROUND OF THE INVENTION

The present invention relates dispensing containers, and more particularly to a ballast apparatus for light weight dispensing containers.

Dispensing containers for light weight articles, such as tissues, have difficulty with remaining in place when a user attempts to remove an in item from the container. In the case of tissue containers, this problem is particularly pronounced when the dispensing container is first opened and the container is relatively full. The problem is also encountered when the dispenser is close to an empty condition. In these circumstances, when the user attempts to use for example a tissue, the whole container may lift from its place, without dispensing the tissue. As such, a user may need to utilize another hand to hold the container while withdrawing a tissue from the container. This is inconvenient, and may facilitate the spread of germs when multiple users may be utilizing the same dispenser. More susceptible containers may be found in a common area of an office, restrooms, and especially in a doctor's office where sick people may be present in higher numbers.

As can be seen, there is a need for an apparatus that can stabilize a dispenser to facilitate single handed dispensing of articles from the container.

SUMMARY OF THE INVENTION

In one aspect of the present invention, a dispenser ballast, includes a substantially flat plate having a first end and a second end. The first end has a pointed tip adapted for insertion between a sidewall of the dispenser and a flap adhered to the sidewall of the dispenser. The flat plate is has a length such that it is substantially contained beneath the flap when inserted. The dispenser ballast may also be configured with a tab extending laterally outward from the second end of the substantially flat plate. The tab may be dimensioned to extend outward by at least a thickness of the flap.

In certain embodiments of the invention, a bevel is defined along an edge surface of the pointed tip. The substantially flat plate is formed of a weighted material, which may be a metal or a ceramic.

Other aspects of the invention include a method of weighting a dispenser. The method includes providing a dispenser ballast, having a substantially flat plate with a first end and a second end. The first end has a pointed tip adapted for insertion between a sidewall of the dispenser and a flap adhered to the sidewall, the flat plate should have a length such that it is substantially contained beneath the flap when inserted.

The method includes inserting the dispenser ballast between the sidewall and the flap. In certain preferred embodiments, the method includes inserting the dispenser ballast until a tab extending laterally outward from the second end of the substantially flat plate contacts a side edge of the flap. In other aspects of the invention, the method includes removing the dispenser ballast from the dispenser when a supply of articles carried by the dispenser has been depleted.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a weighted ballast that may be readily secured within a dispenser carton.

Figure 2:
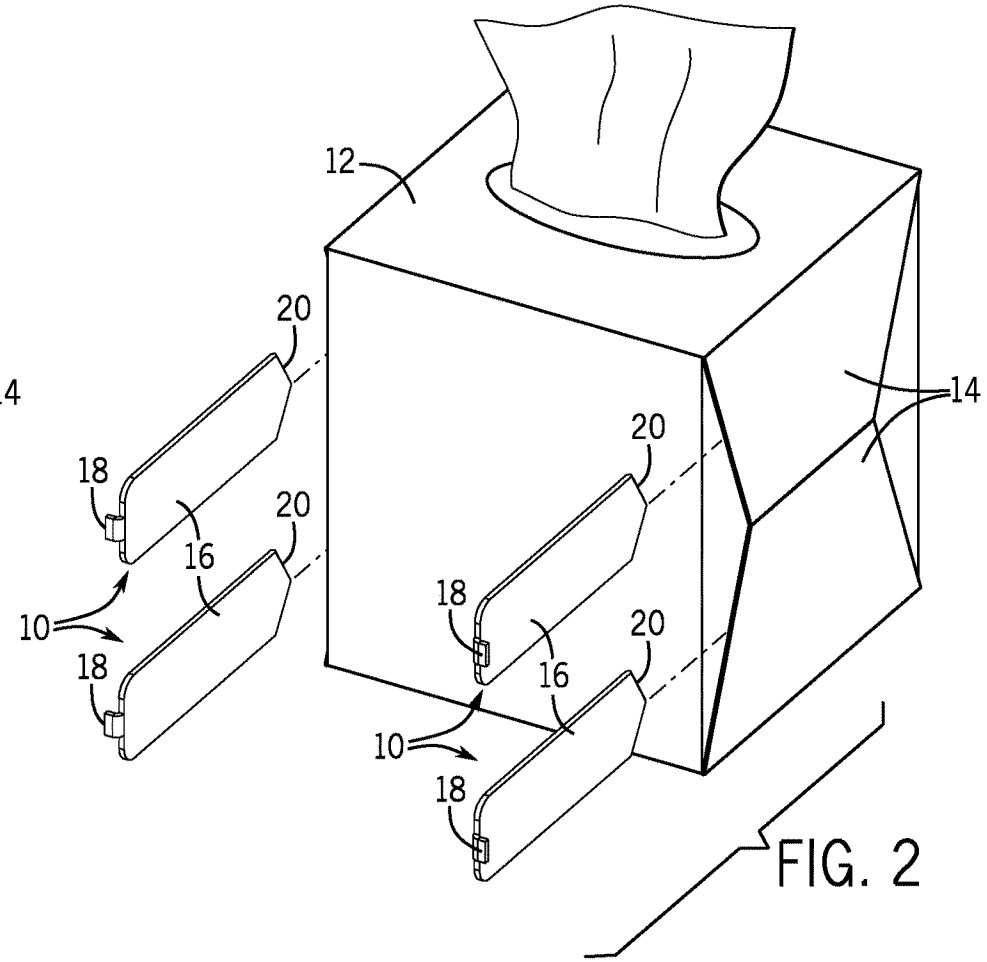
FIG. 2 is an exploded perspective view of an embodiment of a dispenser ballast in use.
Figure 1:
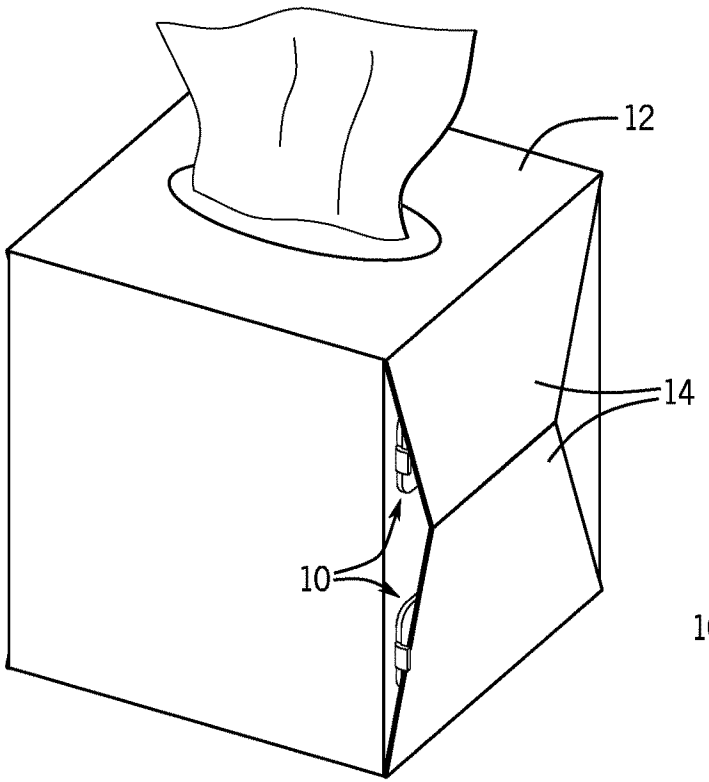
FIG. 1 is a perspective view of an embodiment of a dispenser ballast in use.

As seen in reference to FIG. 1 a dispenser ballast 10 is illustrated in use with a dispenser container, in this case a carton of tissues 12. The dispenser carton 12 is typically made of a cardboard material that is folded into shape and will typically have flaps or tabs 14 that may be joined with the carton 12 via an adhesive. One or more dispenser ballasts 10 may be inserted beneath the flap 14 and conveniently received in a void between the adhesive and the body of the carton 12.

Figure 4:
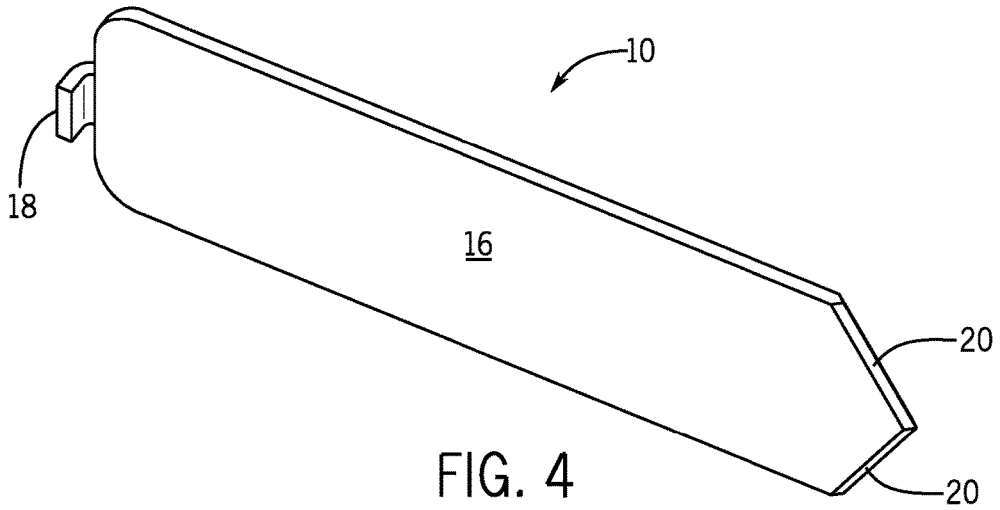
FIG. 4 is a perspective view of the dispenser ballast.
Figure 5:
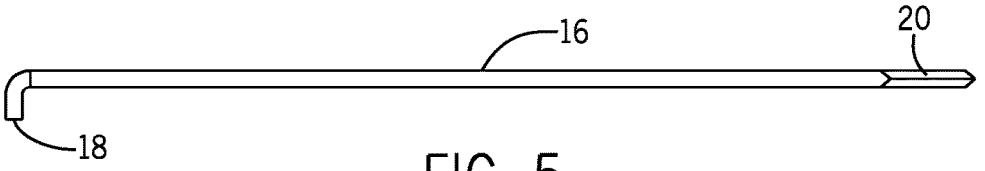
FIG. 5 is a top view of the dispenser ballast.
Figure 6:
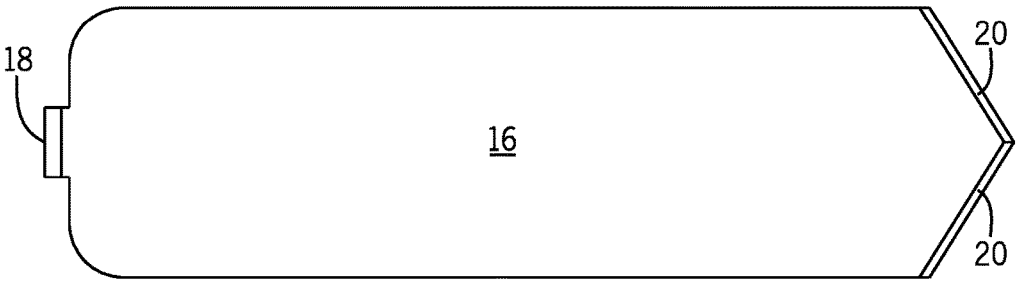
FIG. 6 is a front elevation view of the dispenser ballast.

As seen in reference to FIGS. 4-6, the dispenser ballast 10 may be formed from a substantially flat plate 16, formed of a dense weighted material, such as metal, ceramics, or the like. The plate 16 has a first end 20 that is pointed to facilitate insertion of the ballast 10 between the flap 14 and the container 12. The point 20 may have beveled side edges to assist with lifting or wedging the point 20 beneath the flap 14 for initial insertion of the ballast 10. The point 20 may further guide the first end of the ballast around the adhesive layer securing the flap 14 to the carton 12.

Figure 3:
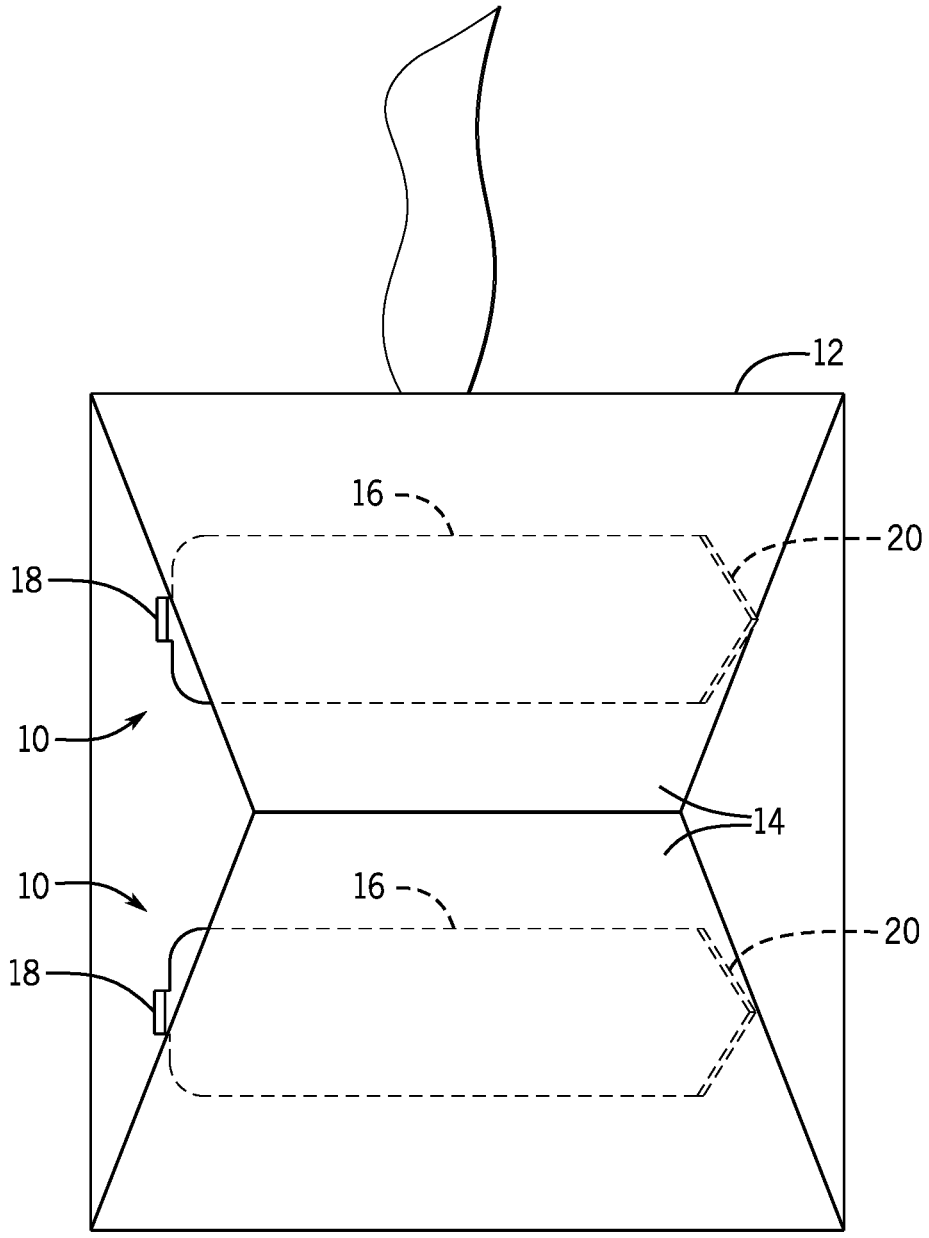
FIG. 3 is a side elevation view of the dispenser ballast in use.

The ballast 10 has a second end 18 that may be blunt or slightly rounded to facilitate pushing the ballast 10 between the flap 14 and the walls of the container 12. In a preferred embodiment, the second end of the ballast 10 has a tab 18 that protrudes from an outer face of the flat plate 16. As seen in reference to FIG. 3, the tab 18 is preferably dimensioned to extend outwardly from the outer face of the flat plate 16 by at least the thickness of the flap 14 so that tab 18 may engage with a side edge of the flap 14. In this case, the tab 18 serves as a stop to limit the insertion of the ballast 10 beneath the flap 14. More preferably, the tab 18 is dimensioned to be slightly greater that the thickness of the flap 14 so that the tab 18 may be accessible by a user's finger tips to facilitate extraction of the ballast 10 from the carton 12 when the contents of the carton 12 have been depleted. The ballast 10 may then be reused with a new dispensing carton 12.

For optimum performance, the ballast 10 may be coated with a frictional coating that will facilitate the side surfaces of the ballast with griping the inner surfaces of the container 12 into which they are inserted and be retained therein until removed by the user. The coating may be of a resilient, or rubberized compound, or the like.

According to the present invention, a plurality of dispenser ballasts 10 may be inserted beneath the various flaps 14 of the carton 12 to provide additional mass for the particular dispenser 12. In the embodiments shown, each of the plurality of dispenser ballasts 10 are received within its own flap 14 pocket. Depending on the configuration of the particular dispenser 12, where there are for example fewer flaps 14, two or more ballasts 10 may also be inserted beneath the same flap 14 to provide sufficient weight for maintaining the dispenser in place.

It should be understood, of course, that the foregoing relates to exemplary embodiments of the invention and that modifications may be made without departing from the spirit and scope of the invention as set forth in the following claims.

What is claimed is:

1. A dispenser container ballast for securement with a dispenser container, consisting of:

a substantially flat plate having a first end and a second end, wherein the first end has a pointed tip including beveled side edges configured for wedging the pointed tip beneath a flap of the dispenser container for insertion between a sidewall of the dispenser container and the flap overlying a portion of the sidewall, the second end having a tab that protrudes from an outer face of the substantially flat plate, the tab configured to engage with a side edge of the flap, the flat plate having a length such that the flat plate is configured to be substantially contained beneath the flap when inserted.

2. The dispenser container ballast of claim 1, wherein the tab extends laterally outward from the second end of the substantially flat plate, by at least the thickness of the flap so that tab may engage with a side edge of the flap.

3. The dispenser container ballast of claim 2, wherein the beveled edge is defined along a first and a second side edge surface of the pointed tip.

4. The dispenser container ballast of claim 3, wherein the substantially flat plate is formed of a weighted material.

5. The dispenser container ballast of claim 4, wherein the weighted material is a metal.

6. The dispenser container ballast of claim 5, wherein the weighted material is a ceramic.

7. The dispenser container ballast of claim 4, wherein the tab is dimensioned to extend outward by at least a thickness of the flap.

8. A method of weighting a dispenser container, comprising:

providing a dispenser ballast, consisting of a substantially flat plate having a first end and a second end, wherein the first end has a pointed tip including beveled side edges configured for wedging the pinted tip beneath a flap of the dispenser container, for insertion of the dispenser ballast between a sidewall of the dispenser container and the flap overlying a portion of the sidewall, the second end having a tab that protrudes from an outer face of the substantially flat plate, the tab configured to engage with a side edge of the flap, the flat plate having a length such that the first end and the second end are configured to be disposed beneath the flap when inserted.

9. The method of claim 8, further comprising:

inserting the dispenser ballast between the sidewall and the flap.

10. The method of claim 9, further comprising;

inserting the dispenser ballast until the tab contacts a side edge of the flap.

11. The method of claim 10, further comprising:

removing the dispenser ballast from the dispenser container when a supply of articles carried by the dispenser container has been depleted.

12. The method of claim 11, further comprising:

manipulating the tab to slidably remove the ballast from the dispenser container.

* * * * *